US008299874B2

(12) United States Patent
Hyde et al.

(10) Patent No.: US 8,299,874 B2
(45) Date of Patent: Oct. 30, 2012

(54) ROLLED RESONANT ELEMENT

(75) Inventors: Roderick A. Hyde, Redmond, WA (US); John Brian Pendry, Cobham (GB); David Schurig, Raleigh, NC (US); David R. Smith, Durham, NC (US); Clarence T. Tegreene, Bellevue, WA (US); Thomas Allan Weaver, San Mateo, CA (US)

(73) Assignee: The Invention Science Fund I, LLC

( * ) Notice: Subject to any disclaimer, the term of this patent is extended or adjusted under 35 U.S.C. 154(b) by 1051 days.

(21) Appl. No.: 12/220,680

(22) Filed: Jul. 25, 2008

(65) Prior Publication Data

US 2010/0019868 A1 Jan. 28, 2010

(51) Int. Cl.
*H01P 1/20* (2006.01)
*H01P 7/08* (2006.01)

(52) U.S. Cl. ..... 333/202; 333/219

(58) Field of Classification Search ..... 333/165–168, 333/175, 176, 185, 202–205, 219, 235
See application file for complete search history.

(56) References Cited

U.S. PATENT DOCUMENTS

| | | | | |
|---|---|---|---|---|
| 7,593,170 | B2 * | 9/2009 | Wu et al. | 359/719 |
| 2003/0112096 | A1 * | 6/2003 | Potter | 333/186 |
| 2008/0088524 | A1 * | 4/2008 | Wang et al. | 343/909 |

OTHER PUBLICATIONS

U.S. Appl. No. 11/355,493, Hyde et al.

Bell et al.; "Three-Dimensional Nanosprings for Electromechanical Sensors"; The 13th International Conference on Solid-State Sensors, Actuators and Microsystems, Seoul, Korea; Jun. 5-9, 2005; pp. 15-18; IEEE.

Chen et al.; "Experimental Retrieval of the Effective Parameters of Metamaterials Based on a Waveguide Method"; Optics Express; Dec. 25, 2006; pp. 12944-12949; vol. 14; No. 26; OSA.

Cho, Adrian; "Pretty As You Please, Curling Films Turn Themselves into Nanodevices"; Science; Jul. 14, 2006; pp. 164-165; vol. 313; AAAS.

Dong et al.; "Nanorobotics for Creating NEMS from 3D Helical Nanostructures"; Journal of Physics: Conference Series; 2007; pp. 257-261; vol. 61; IOP Publishing Ltd.

Golod et al.; "Fabrication of Conducting GeSi/Si Micro- and Nanotubes and Helical Microcoils"; Semiconductor Science and Technology; bearing dates of Nov. 4, 2000, Jan. 19, 2001, and 2001; pp. 181-185; vol. 16; Institute of Physics Publishing Ltd.; United Kingdom.

Kalaugher, Liz; "Helical Nanobelts Roll Up for Devices"; Apr. 7, 2005 and printed on Dec. 13, 2007; pp. 1-4; located at www.nanotechweb.org.

Kipp et al.; "Optical Microtube Ring Resonators Formed by Rolled-Up Strained Semiconductor Bilayers" [Abstract]; 2007 American Physical Society Meeting in Denver Colorado—Mar. 5-9, 2007; bearing a date of Dec. 4, 2006; p. 1; located at http://meetings.aps.org/link/BAPS.2007.MAR.H44.5; Institute of Applied Physics, University of Hamburg, Germany.

Kipp et al.; "Optical Modes in Semiconductor Microtube Ring Resonators"; Physical Review Letters; Feb. 24, 2006; pp. 077403-1-077403-4; The American Physical Society.

Luchnikov, et al.; "Self-Rolled Polymer Microtubes With Engineered Hidden Walls"; Physica E; bearing dates of 2006, Dec. 11, 2006, and 2007; pp. 236-240; vol. 37; Elsevier B.V.

(Continued)

*Primary Examiner* — Benny Lee
*Assistant Examiner* — Gerald Stevens

(57) ABSTRACT

A material including a conductor may be rolled to form a resonant element.

44 Claims, 16 Drawing Sheets

OTHER PUBLICATIONS

Pendry et al.; "Magnetism from Conductors and Enhanced Nonlinear Phenomena"; IEEE Transactions on Microwave Theory and Techniques; Nov. 1999; pp. 2075-2084; vol. 47; No. 11; IEEE.

Pendry et al.; "New Electromagnetic Materials Emphasise the Negative"; Physics World; 2001; pp. 1-5.

Pendry et al.; "The Quest for the Superlens"; Scientific American; Jul. 2006; pp. 60-67; vol. 295; No. 1; Scientific American, Inc.

Prinz, V. Ya.; "New Ultra-Precise Semiconductor and Metal Nanostructures: Tubes, Shells and Their Ordered Arrays"; IEEE; bearing a date of 2003; pp. 199-204; IEEE.

Prinz, V.Ya.; "A New Concept in Fabricating Building Blocks for Nanoelectronic and Nanomechanic Devices"; Microelectronic Engineering; 2003; pp. 466-475; vol. 69; Elsevier B.V.

Seleznev et al.; "Single-Turn GaAs/InAs Nanotubes Fabricated Using the Supercritical $CO_2$ Drying Technique"; Jpn. J. Appl. Phys.; Jul. 1, 2003 and bearing dates of May 8, 2003, May 19, 2003 and 2003; pp. L791-L794; vol. 42; Part 2; No. 7A; The Japan Society of Applied Physics.

Tyukhtin et al.; "Applications of Cherenkov Radiation in Dispersive and Anisotropic Metamaterials to Beam Diagnostics"; Proceedings of PAC07, Albuquerque, New Mexico; 2007; pp. 4156-4158; IEEE.

Vorob'ev et al; Free-Standing InAs/InGaAs Microtubes and Microspirals on InAs (100); Jpn. J. Appl. Phys.; Jan. 15, 2003 and also bearing dates of Dec. 11, 2002, Dec. 12, 2002, and 2003; pp. L7-L9; vol. 42; Part 2; No. 1A/B; The Japan Society of Applied Physics.

Zhang et al.; "Anomalous Coiling of SiGe/Si and SiGe/Si/Cr Helical Nanobelts"; Nano Letters; bearing dates of Nov. 28, 2005, May 3, 2006, and 2006; pp. 1311-1317; vol. 6: No. 7; American Chemical Society.

Zhang et al.; "Fabrication and Characterization of Freestanding Si/Cr Micro—and Nanospirals"; Microelectronic Engineering; bearing dates of Feb. 20, 2006 and 2006; pp. 1237-1240; vol. 83; Elsevier B.V.

* cited by examiner

ROLLED RESONANT ELEMENT

SUMMARY

The foregoing summary is illustrative only and is not intended to be in any way limiting. In addition to the illustrative aspects, embodiments, and features described above, further aspects, embodiments, and features will become apparent by reference to the drawings and the following detailed description.

In one embodiment, a method of fabricating a component comprises: determining a first discontinuous conductive pattern corresponding to a first unrolled state, the first discontinuous conductive pattern being selected to produce a first regional effective permeability in a first rolled state; applying a first conductor in the first discontinuous conductive pattern to a first portion of a first non-conductive layer; and rolling the first portion of the first non-conductive layer such that the first discontinuous conductive pattern forms a first element having the first regional effective permeability.

In another embodiment, a method of fabricating a metamaterial, comprises: determining a first regional effective permeability range; determining a first pattern corresponding to a first unrolled state, the first pattern being selected to define a plurality of effectively discrete electromagnetic structures corresponding to the first regional effective permeability range in a first rolled state; applying a first conductor in the first pattern on a first non-conductive layer; and rolling the first non-conductive layer into the first rolled state to form the plurality of effectively discrete electromagnetic structures.

In another embodiment, a resonant element is achieved by the process of: determining a first discontinuous conductive pattern corresponding to a first unrolled state, the first conductive pattern being selected to produce a first regional effective permeability in a first rolled state; applying a first conductor in the first conductive pattern to a first portion of a first non-conductive layer; and rolling the first portion of the first non-conductive layer such that the first conductive pattern forms a first element having the first regional effective permeability.

In another embodiment an apparatus comprises: a first layer of a first material; and a substantially discontinuous patterned conductor on the first layer, wherein the first layer and the patterned conductor form a rolled structure, and wherein the rolled patterned conductor forms a first resonant element responsive to electromagnetic energy to resonate at a first resonant frequency, the first resonant element having at least one anomalous electromagnetic property in a first frequency range proximate to the first resonant frequency.

In another embodiment a metamaterial comprises: a first layer of a first material; and a discontinuous patterned conductor on the first layer, wherein the first layer and the patterned conductor form a first rolled structure, the first rolled structure forming a first array of discrete electromagnetic elements, and wherein the first array of discrete electromagnetic elements is characterized by a net effective permeability, the net effective permeability being negative in a first frequency range.

In another embodiment a method comprises: determining a first regional effective permeability range corresponding to a first range of electromagnetic frequencies; and determining a first discontinuous conductive pattern corresponding to a first unrolled state, the first discontinuous conductive pattern being selected to produce the first regional effective permeability range corresponding to the first range of electromagnetic frequencies in a first rolled state.

In another embodiment a method comprises: determining a first regional effective permeability range corresponding to a first range of electromagnetic frequencies; determining, for a coiled substantially planar substrate, a first discontinuous conductive pattern corresponding to the first regional effective permeability range corresponding to a first range of electromagnetic frequencies; determining an uncoiled conductive pattern corresponding to the determined first discontinuous conductive pattern corresponding to the first regional effective permeability range corresponding to a first range of electromagnetic frequencies; patterning a substrate with the determined uncoiled conductive pattern corresponding to the determined first discontinuous conductive pattern corresponding to the first regional effective permeability range corresponding to a first range of electromagnetic frequencies; and coiling the patterned substrate to produce the coiled substantially planar substrate.

DETAILED DESCRIPTION

Figure 1:
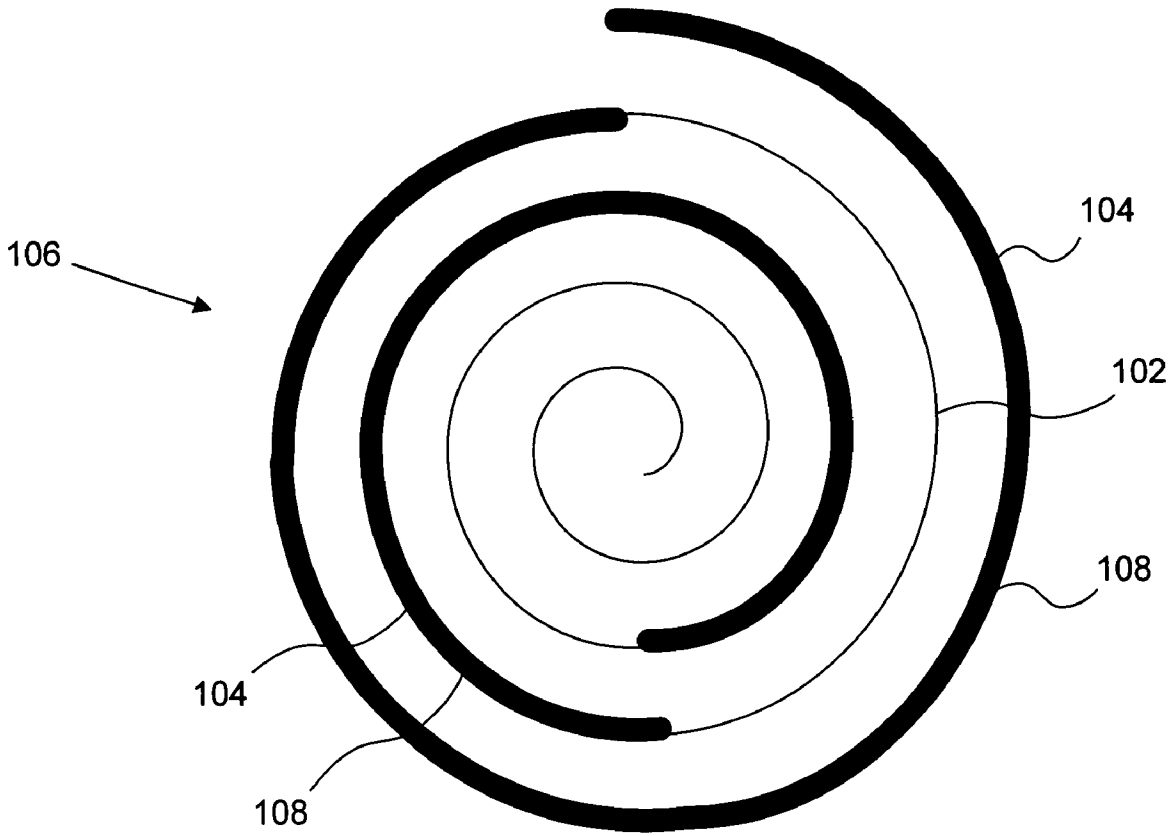
FIG. 1 shows a split-ring resonator.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1 shows a cross section of a rolled structure 106 that forms a split-ring resonator 108, where the rolled structure 106 is formed from a first layer 102 of a first material patterned with a substantially discontinuous patterned conductor 104. While the representation of FIG. 1 presents a cross-sectional view of a portion of the split ring resonator 108 wherein the substantially discontinuous patterned conductor 104 has two discrete segments, other structures incorporating fewer, or more segments may be appropriate for some applications. Moreover, as will be described herein, the discontinuous patterned conductor 104 may extend axially or may include a plurality of sections displaced axially relative to the two-dimensional representation.

One approach to rolling materials on a small-scale allowing for the creation of small-scale conductive elements is described, for example, in, "Pretty as You Please, Curling Films Turn Themselves into Nanodevices," Adrian Cho, Science, 14 Jul., 2006, Volume 313, pp. 164-165, which is incorporated herein by reference. Such methods can be adapted, as described herein to produce a variety of structures that may incorporate conductive, inductive, capacitive, active, or other electrically or electromagnetically interactive structures, components or sub-structures.

Figure 2:
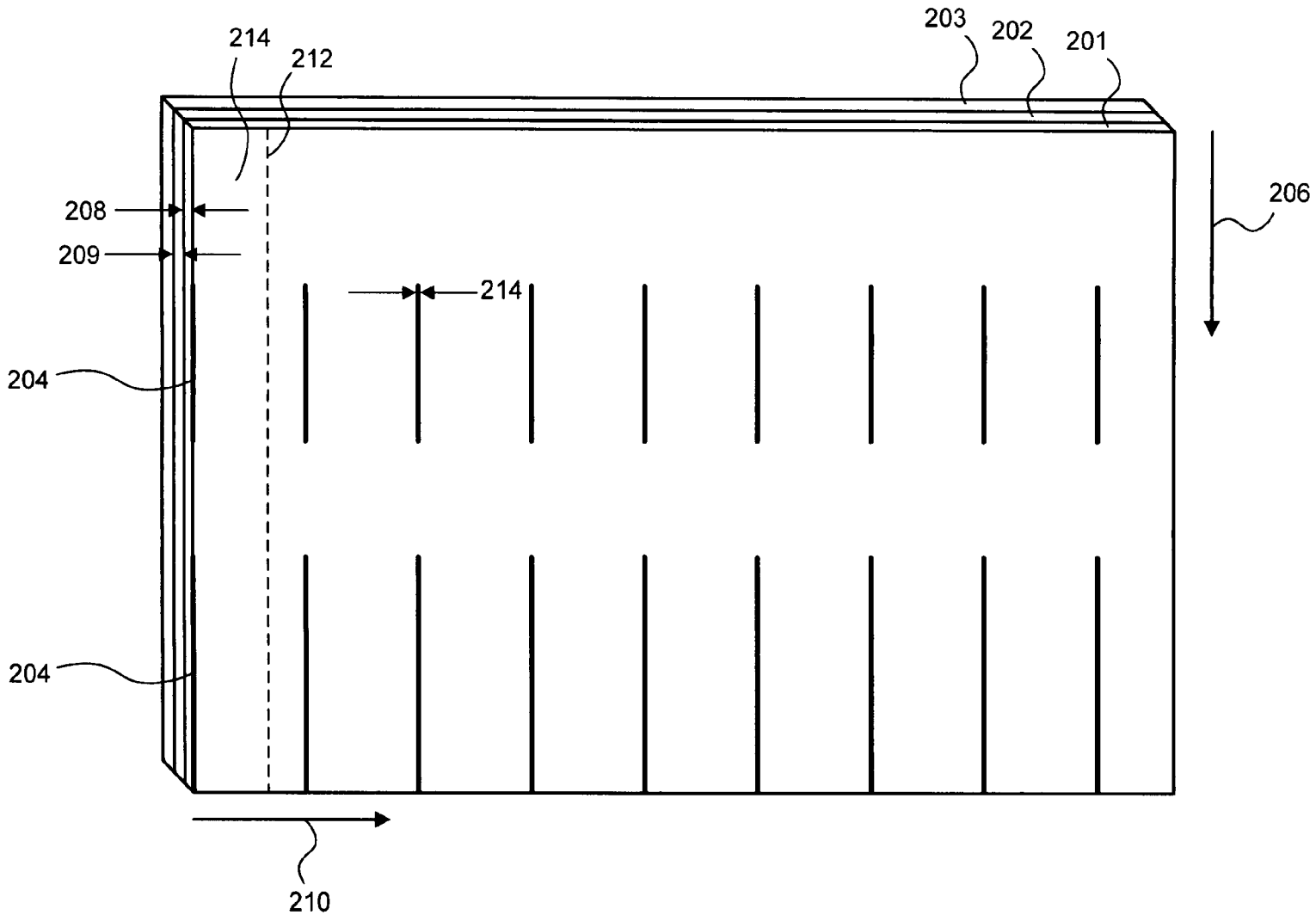
FIG. 2 shows a layer with a substantially discontinuous patterned conductor.
Figure 3:
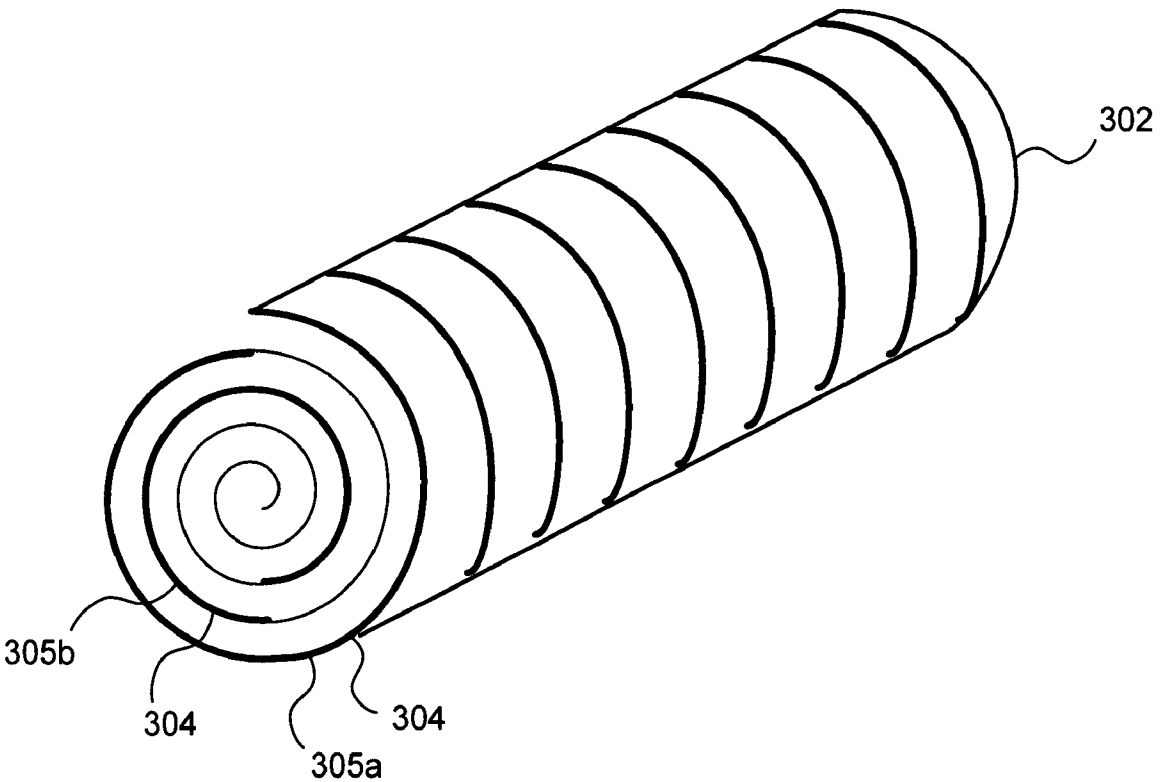
FIG. 3 shows a rolled structure.

In an embodiment shown in FIGS. 2 and 3, an apparatus comprises a first layer 201 of a first material and a second layer 202 of a second material on a substrate 203 and a substantially discontinuous patterned conductor 204 on the first layer 201, shown in an unrolled state in FIG. 2. The substrate 203 may be patterned (e.g., deposited and etched away using conventional photolithographic techniques; selectively deposited through a patterned mask; or any other appropriate technique) such that the first layer 201, the second layer 202 and the patterned conductor 204, when rolled form a rolled structure 302, shown in the rolled state in FIG. 3.

Figure 4:
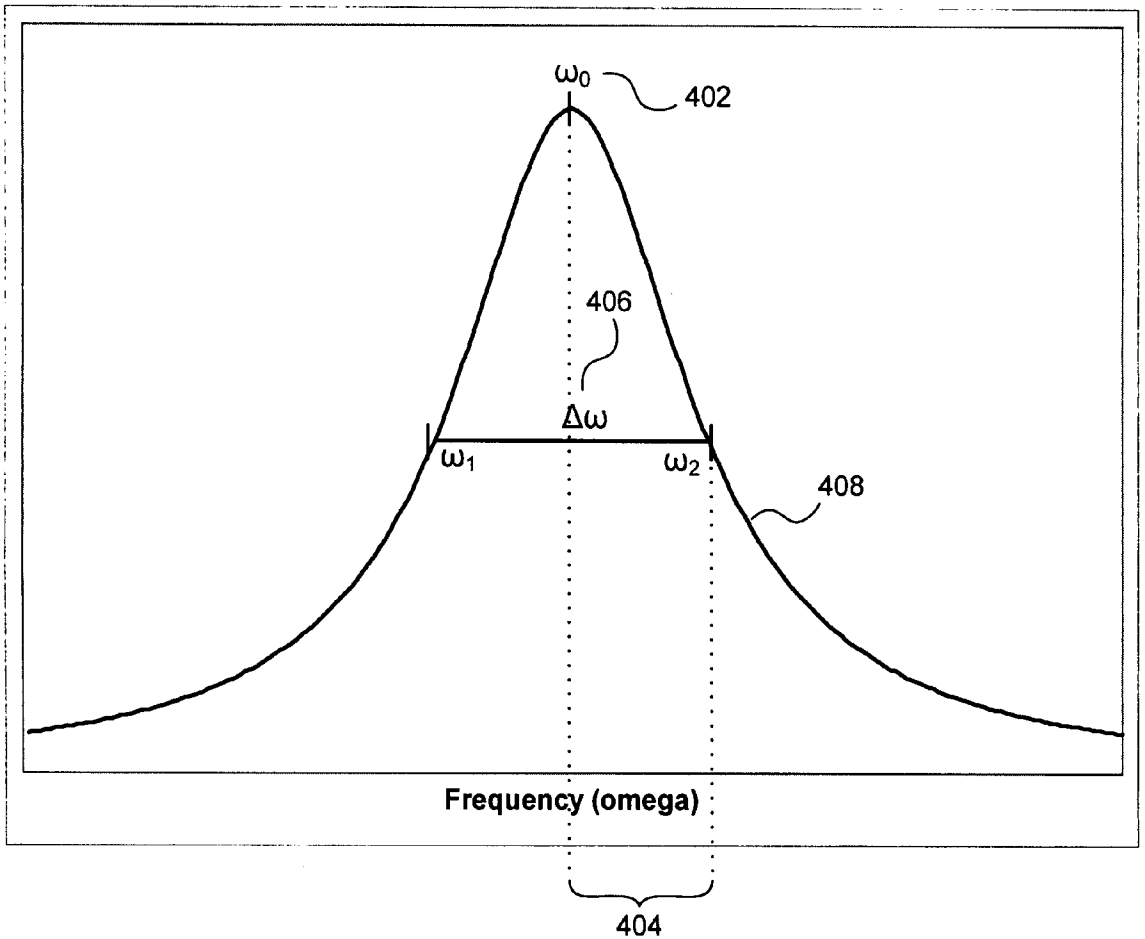
FIG. 4 shows a response of an element to electromagnetic energy.

Upon rolling of the substrate 203 in the rolling direction 206, the patterned conductor 204 (shown in FIG. 2) rolls to form a first resonant element 304, having two discrete portions 305*a*, 305*b* shown in FIG. 3, that is responsive to electromagnetic energy to resonate at a first resonant frequency 402, shown in FIG. 4. The first resonant element 304 is configured to have at least one anomalous electromagnetic property in a first frequency range 404 proximate to the first resonant frequency 402, as shown in FIG. 4.

Note that although the first resonant element 304 is presented as having only two discrete portions 305*a*, 305*b*, in some applications or configurations, the first resonant element 304 may have more than two portions. Moreover, while the two discrete portions 305*a*, 305*b* are shown as being electrically isolated, in some applications, the discrete portions 305*a*, 305*b* may be selectively coupled. For example, in some approaches, the discrete portions 305*a*, 305*b* may be DC-coupled while remaining substantially electromagnetically isolated at operating frequencies. Similarly, a frequency selective circuit, conductor, or other element may be coupled between the discrete portions 305*a*, 305*b*. One skilled in the art could select the electromagnetic properties of a frequency selective circuit, conductor, or other element coupled between the discrete portions 305*a*, 305*b* to maintain the anomalous electromagnetic property.

Although FIG. 2 shows the first layer 201 and the second layer 202 on a substrate 203, in other embodiments there may be no substrate 203, or there may be only the first layer 201 and the substrate 203, or there may be more layers than those shown. Further, some layers may be etched away as the substrate 203 is, or they may not be etched away and may roll up with the first layer 201.

The at least one anomalous electromagnetic property may include a negative permeability, a negative permittivity, a negative refractive index, or a different anomalous electromagnetic property. Anomalous electromagnetic properties such as negative permittivity, negative permeability, and negative index of refraction are known to those skilled in the art, and are described in, "New electromagnetic materials emphasize the negative," John Pendry, Physics World, 2001, pp. 1-5, which is incorporated herein by reference. Although the first frequency range 404 in which the anomalous electromagnetic property occurs is shown in FIG. 4 as being just above the resonant frequency 402, in other embodiments the first frequency range 404 may be in a different position relative to the resonant frequency 402.

FIG. 2 is shown such that the first layer 201, when rolled to form the rolled structure 302 shown in FIG. 3, forms nine different split-ring resonators. However, different embodiments may include different numbers or different types of resonant elements. In some embodiments the rolled structure 302 may include only one resonant element 304; in other embodiments it may include a larger or smaller number of resonant elements 304 than is shown in FIGS. 2 and 3.

Further, although the patterned conductor 204 shown in FIG. 2 is shown such that it may produce nine resonant elements 304 having substantially equal dimensions, in other embodiments the patterned conductor 204 may be formed to create resonant elements 304 having different dimensions. For example, the thickness 208 of the first layer 201 (and/or second layer 202) may be configured to vary along the direction 210 to produce resonant elements having different dimensions and, for example, different resonant frequencies 402.

In some embodiments, the dimensions of the resonant element 304 may be selected such that the resonant element 304 will couple to electromagnetic energy in a first frequency range 406. FIG. 4 shows an exemplary response of a resonant element 304 to electromagnetic energy. The peak of the curve 408 corresponds to the resonant frequency 402 of the resonant element 304, and as shown in FIG. 4 the frequency range 406 corresponds to the full width at half maximum of the curve. In other embodiments, however, the frequency range 406 may be defined in a different way, and the curve 408 may have a different shape than that shown in FIG. 4. The frequency range 406 may include optical frequencies, microwave frequencies, and/or a different frequency range.

Further, in some embodiments the resonant element 304 may be configured to couple to electromagnetic energy having a specific polarization. In this case, the resonant element 304 may be oriented with respect to incoming electromagnetic energy and/or oriented with respect to other resonant elements 304 in order to couple to this specific polarization.

The first layer 201 may be rolled in a number of ways. For example, as described in Cho, a first layer 201 and a second layer 202 consisting of two different materials may be fabricated on a substrate 203, and when the substrate 203 is removed, the two layers 201 and 202 may roll to form the rolled structure 302 shown in FIG. 3. Specifically, Cho describes that the first layer 201 may be silicon, the second layer 202 may be silicon mixed with germanium the first layer and the second layer having different atomic spacings), and the substrate 203 may be soluble such that it may be etched away. Other combinations of materials may be used for the first and second layers 201, 202, and materials may be selected such that the layers 201 and 202 have atoms of different sizes to induce rolling of the layers 201, 202.

In some embodiments, lithography may be used to pattern the first layer 201 and/or the second layer 202. For example, in some embodiments a trench may be etched into the first layer 202 at all or part of the location of the substantially discontinuous patterned conductor 204 before the conductive material is applied. In other embodiments lithography may be used to define the boundaries of the first and/or second layers 201, 202 to roll up, such as the line 212 shown in FIG. 2. For example, in an embodiment where a single resonant element 304 is created, the line 212 may be etched such that only the portion 214 to the left of the line 212 will roll up, creating a single resonant element 304. Lithography or other techniques may be used in other ways not described to divide area, to etch trenches or other designs into layers such as the layers 201, 202, or for other reasons.

Although the first resonant element 304 shown in FIG. 3 is substantially two-dimensional, in other embodiments the element may be substantially three-dimensional. For example, the first layer 201 and/or the second layer 202 may be configured to roll at an angle, producing a substantially helical resonant element. Or, the substantially discontinuous, patterned conductor 204 may be deposited in a pattern that is configured to produce one or more three-dimensional resonant elements, or sets of rolled resonant elements having central axes that may be non-parallel.

Figure 5:
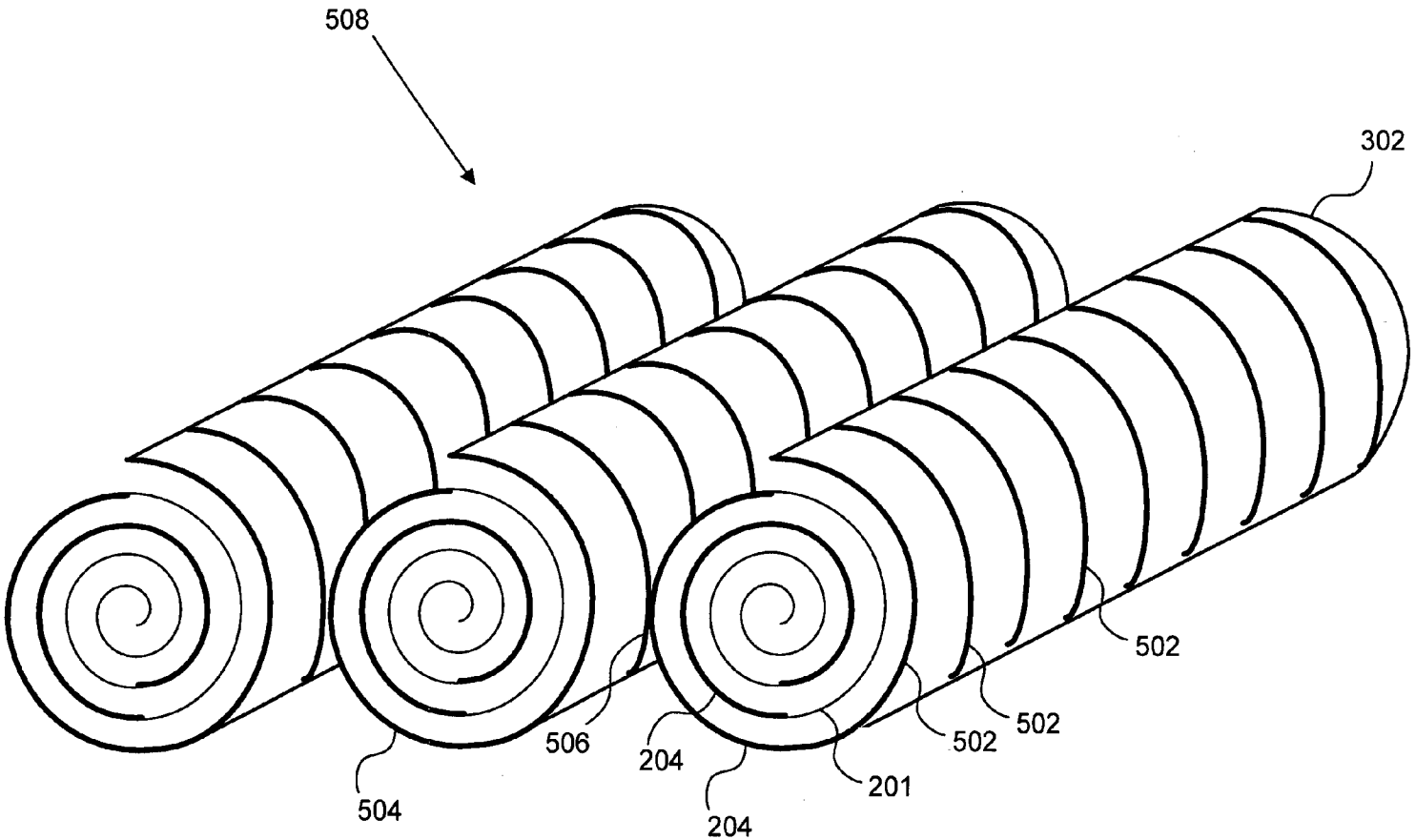
FIG. 5 shows a metamaterial.

In an embodiment shown in FIG. 5, a metamaterial comprises a first layer 201 of a first material, a discontinuous patterned conductor 204 on the first layer 201, wherein the first layer 201 and the patterned conductor 204 form a first rolled structure 302, the first rolled structure 302 forming a first array of discrete electromagnetic elements 502, and wherein the first array of discrete electromagnetic elements 502 is characterized by a net effective permeability, the net effective permeability being negative in a first frequency range (such as the frequency range 404 shown in FIG. 4).

In one embodiment, a first discrete electromagnetic element 504 may be further characterized by a first regional effective permeability and a second conductive element 506 may be characterized by a second regional effective permeability different from the first regional effective permeability. For example, the first and or second layers 201, 202 as shown in FIG. 2 may have thicknesses 208, 209 that vary along the direction 210, such that when the layers 201, 202 roll, the resulting electromagnetic elements (such as 504 and 506) have dimensions that vary along the direction 210. This may be done, for example, to produce elements that couple to different frequencies of electromagnetic radiation. For example, the entire rolled structure 302 may be just one component in a metamaterial 508 that responds to different frequencies of electromagnetic radiation.

Although FIG. 5 shows three rolled structures 302, a metamaterial may include many rolled structures stacked in three dimensions. For example, where a rolled structure 302 is long and includes hundreds of resonant elements 304, many rolled structures 302 may be stacked like logs to produce a metamaterial structure. Or, many of the aforementioned stacked log structures may be incorporated together in different ways to form a metamaterial.

Further, the resonant elements 304 may be incorporated with other resonant elements, such as wires, to produce other electromagnetic effects. For example, as described in, "The Quest for the Superlens", J. B. Pendry and D. R. Smith, Scientific American, Volume 295, Number 1, pp. 60-67, July 2006, which is incorporated herein by reference, metamaterials may typically include split-ring resonators and conductive wires to achieve the desired electromagnetic effects. The rolled structure may further incorporate other components mounted, for example, on the first layer 201 prior to rolling. For example, other components may include capacitors, resistors, inductors, quantum dots, and/or other elements which may or may not be powered electrically, electromagnetically, or in another way. The components may or may not be directly electrically connected to one or more of the discrete electromagnetic elements. For example, a component may be configured such that it is electrically connected to one or both of the discrete portions 305*a*, 305*b* of the resonant element 304. The component(s) may be incorporated on the first layer 201, may be embedded in the first layer 201, may be embedded in the second layer 202, and/or may be incorporated into the rolled structure 302 in a different way.

In another approach which may be separate or may be supplemental to those described previously, the other components may include structures or materials that affect electromagnetic properties, such as dielectric constant, permeability, permittivity, resistance, or similar. In one such approach, the other components may include one or more layers (e.g., polymeric or other films) having controlled electromagnetic properties. As a non-limiting example, the layers may include patterned (or un-patterned) dielectric portions, patterned (or un-patterned) materials having non-unity permeability (e.g., ferromagnetic materials, layered films, nanocrystalline materials or similar), patterned (or un-patterned) resistive electro-optic, or semiconductive materials.

Further, although FIG. 5 shows the rolled structures 302 oriented substantially parallel to one another, in other embodiments they may be oriented in a different way with respect to one another. Or, some of the rolled structures 302 may be oriented parallel to one anther and some may be oriented, for example, perpendicular to one another. The rolled structures 302 may include resonant elements 304 of varying sizes and having varying resonant frequencies 402, and may include resonant elements different from that shown in FIG. 3.

In some embodiments, different resonant elements 304 (for example, adjacent and/or neighboring resonant elements 304) may be electrically coupled, wherein the electrical coupling may include elements such as resistive, capacitive, inductive, and/or other types of elements.

Although the terms, 'resonant element', 'conductive element', and 'electromagnetic element' have been used for the structure 304, 504 and 506, other terms may be used to describe these, such as metamolecules, metamaterial components, or a different term.

In some embodiments, the resonant elements 304 may be powered and/or otherwise electrically controlled, as described in VARIABLE METAMATERIAL APPARATUS, U.S. application Ser. No. 11/355,493, Hyde et al., which is commonly assigned herewith and is incorporated herein by reference.

Generally, the devices shown in FIGS. 1-3 and FIG. 5 are shown having certain sizes and dimensions for illustrative purposes only. For example, the lines formed by the substantially discontinuous, patterned conductor 204 shown in FIG. 2 may be thicker or thinner than the thickness 214 that is shown, depending on the application. The electromagnetic properties of the resonant element 304 may be a function of the thickness 214 of these lines, and thus this thickness may be selected according to the particular application. The materials and dimensions of the first and/or second layers 201, 202 may also be selected according to the particular application, and different choices for materials and/or material thicknesses may produce rolled structures 302 having different properties.

Dimensions of resonant elements 304 may be selected such that the resonant element 304 interacts with energy in a certain energy range and/or to produce a desired permeability and/or permittivity. The relationship between the dimensions of various kinds of metamaterial elements (including split ring resonators) and their effective permeability is described in, "Magnetism from Conductors and Enhanced Nonlinear Phenomena," J. B. Pendry et al., IEEE Trans. Micr. Theory and Techniques, 11 Nov. 1999, Volume 47, Number 11, pp. 2075-2084, which is incorporated herein by reference. Examples of complex permeability and permittivity tensors for metamaterials are given in, "Applications of Cherenkov Radiation in Dispersive and Anisotropic Metamaterials to Beam Diagnostics," A. V. Tyukhtin et al., Proceedings Particle Accelerator Conference PAC2007, Albuquerque, N.M., pp. 4156-4158, which is incorporated herein by reference.

In some embodiments, the complex permeability and/or permittivity of structure(s) may be determined empirically, as is described, for example, in "Experimental retrieval of the effective parameters of metamaterials based on a waveguide method," Hongsheng Chen et al., Optics Express, 25 Dec. 2006, Volume 14, Number 26, pp. 12944-12949, which is incorporated herein by reference.

Following are a series of flowcharts depicting implementations. For ease of understanding, the flowcharts are organized such that the initial flowcharts present implementations via an example implementation and thereafter the following flowcharts present alternate implementations and/or expansions of the initial flowchart(s) as either sub-component operations or additional component operations building on one or more earlier-presented flowcharts. Those having skill in the art will appreciate that the style of presentation utilized herein (e.g., beginning with a presentation of a flowchart(s) presenting an example implementation and thereafter providing additions to and/or further details in subsequent flowcharts) generally allows for a rapid and easy understanding of the various process implementations.

Figure 6:
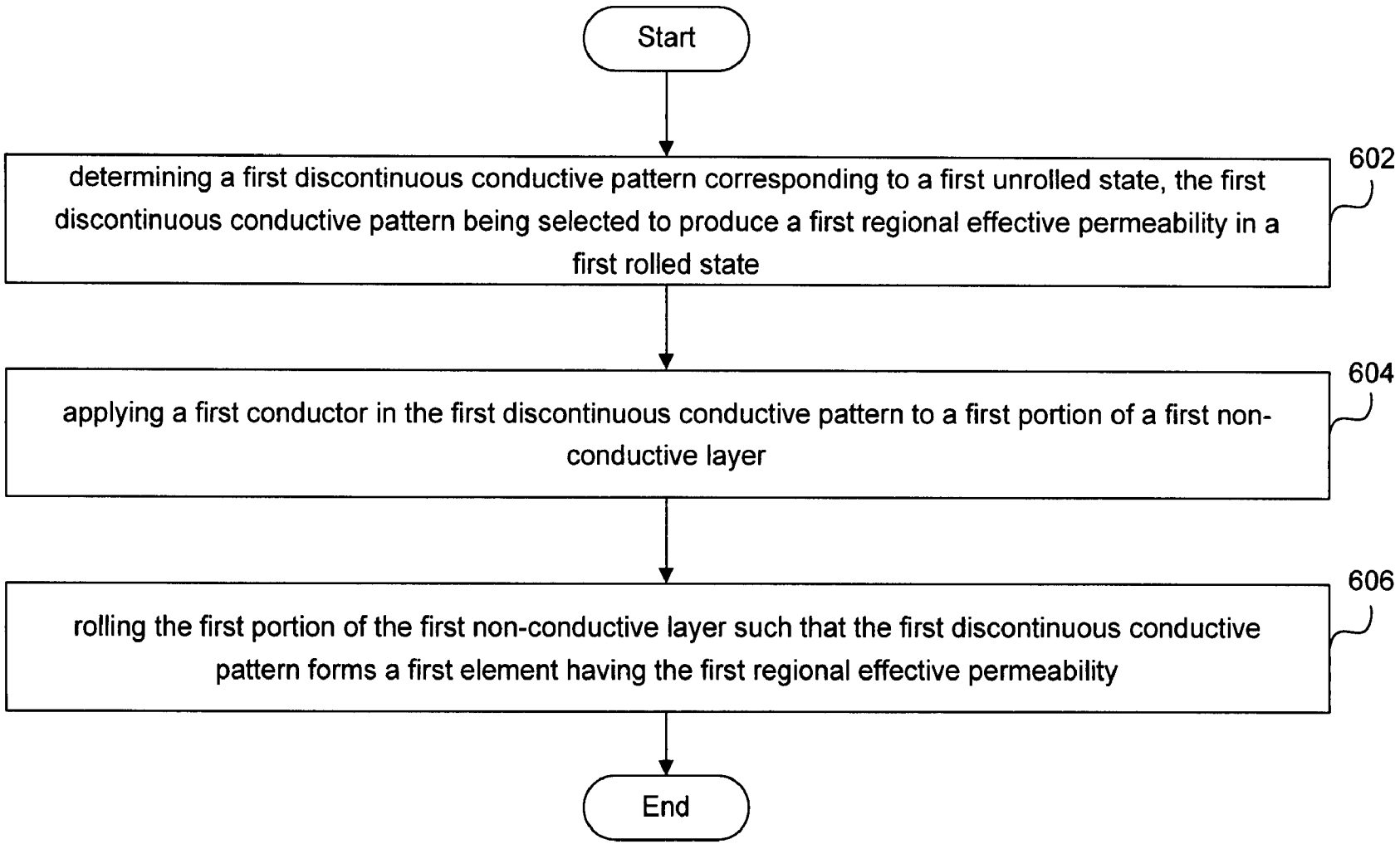
FIG. 6 is a flow chart depicting a method.

In one embodiment, a method, shown in the flow chart of FIG. 6, comprises (602) determining a first discontinuous conductive pattern corresponding to a first unrolled state, the first discontinuous conductive pattern being selected to produce a first regional effective permeability in a first rolled state, (604) applying a first conductor in the first discontinuous conductive pattern to a first portion of a first non-conductive layer, and (606) rolling the first portion of the first non-conductive layer such that the first discontinuous conductive pattern forms a first element having the first regional effective permeability.

Figure 7:
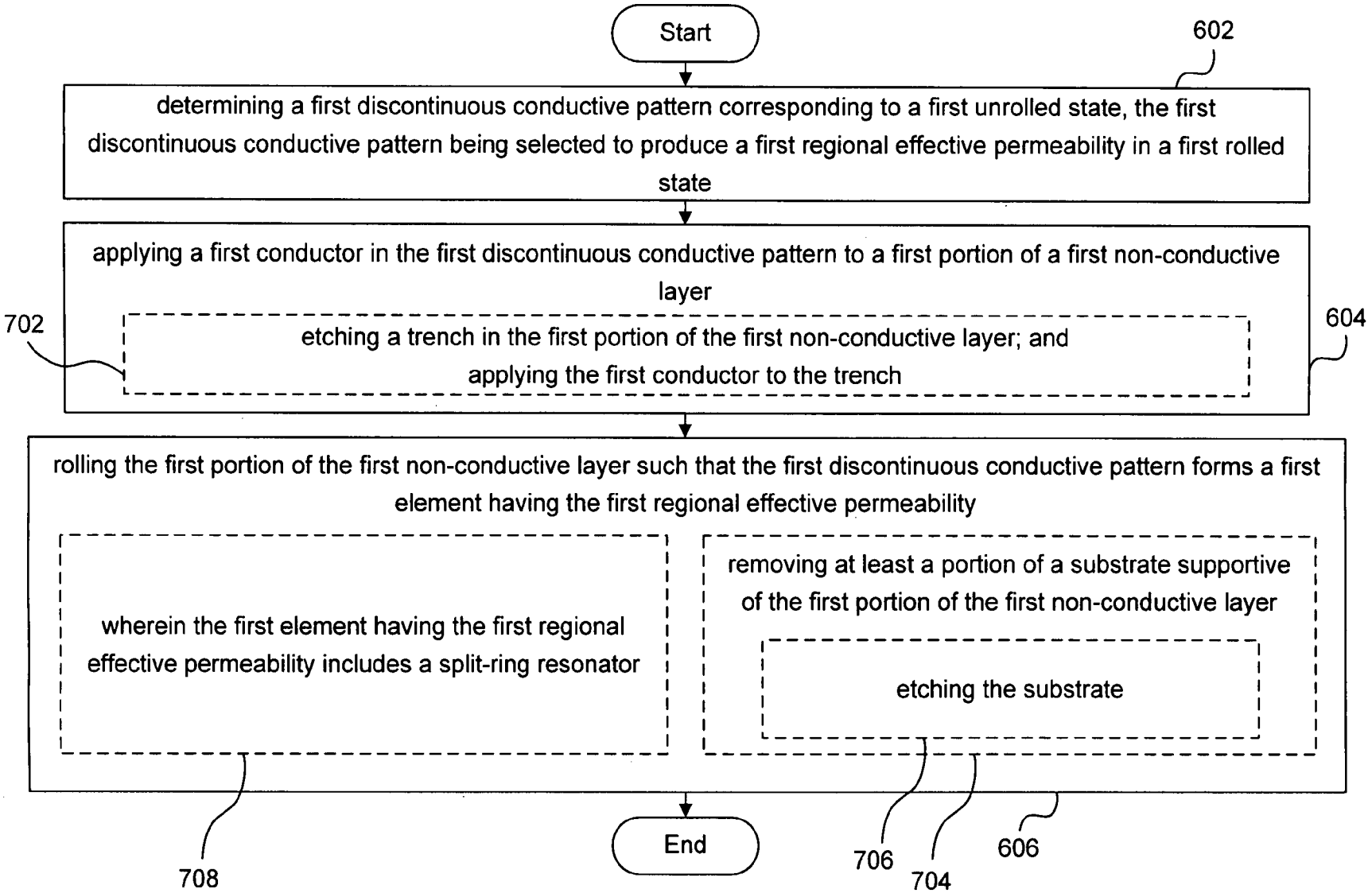
FIGS. 7-9 depict variants of the flow chart of FIG. 6.

As shown in the flow chart of FIG. 7, (604) applying a first conductor in the first discontinuous conductive pattern to a first portion of a first non-conductive layer may include (702) etching a trench in the first portion of the first non-conductive layer; and applying the first conductor to the trench. (606) Rolling the first portion of the first non-conductive layer such that the first discontinuous conductive pattern forms a first element having the first regional effective permeability may include (704) removing at least a portion of a substrate supportive of the first portion of the first non-conductive layer, which may further include (706) etching the substrate. In some cases, (708) the first element having the first regional effective permeability may include a split-ring resonator.

Figure 8:
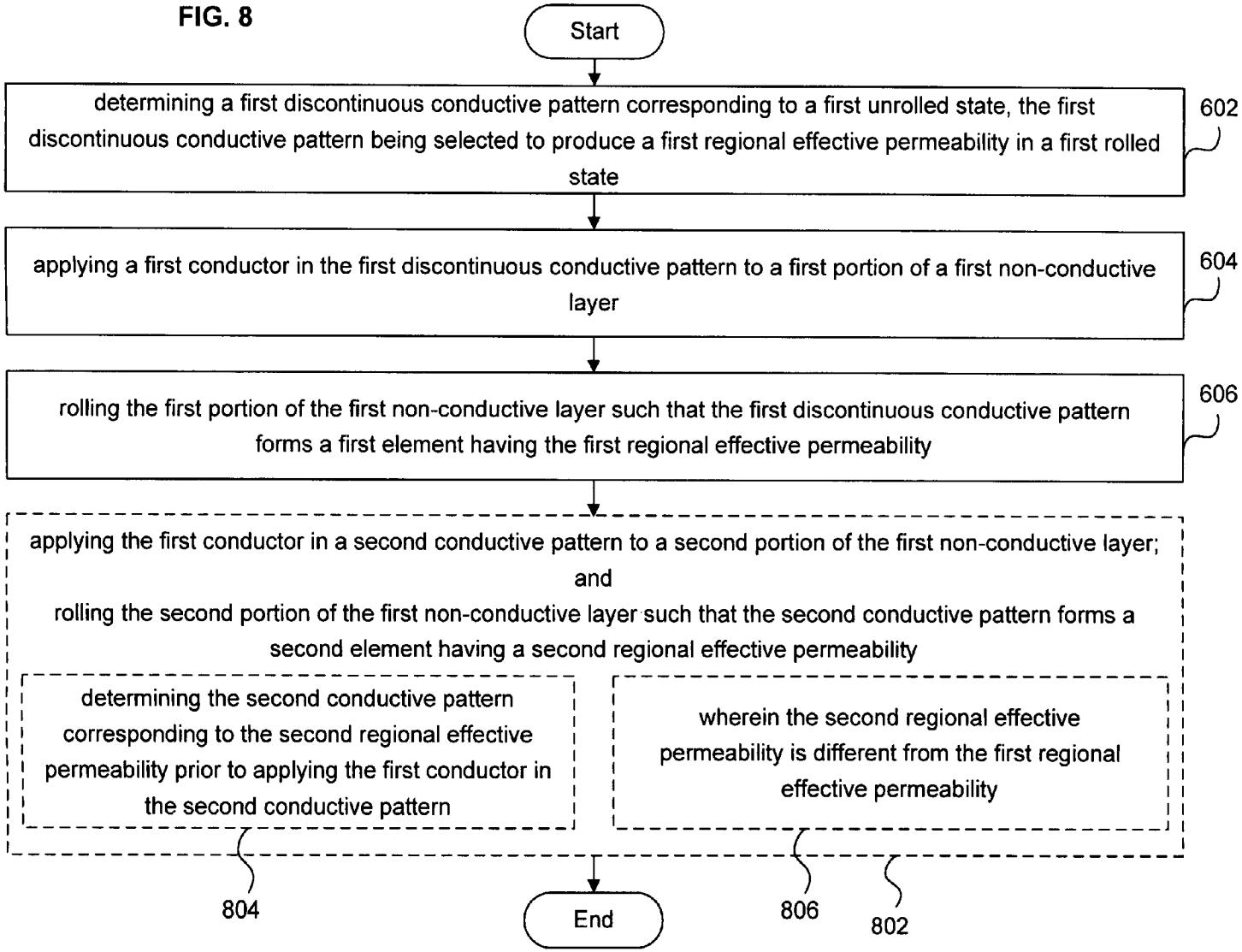

As shown in the flow chart of FIG. 8, the method may further comprise (802) applying the first conductor in a second conductive pattern to a second portion of the first non-conductive layer; and rolling the second portion of the first non-conductive layer such that the second conductive pattern forms a second element having a second regional effective permeability, which may further include (804) determining the second conductive pattern corresponding to the second regional effective permeability prior to applying the first conductor in the second conductive pattern and/or (806) wherein the second regional effective permeability may be different from the first regional effective permeability.

Figure 9:
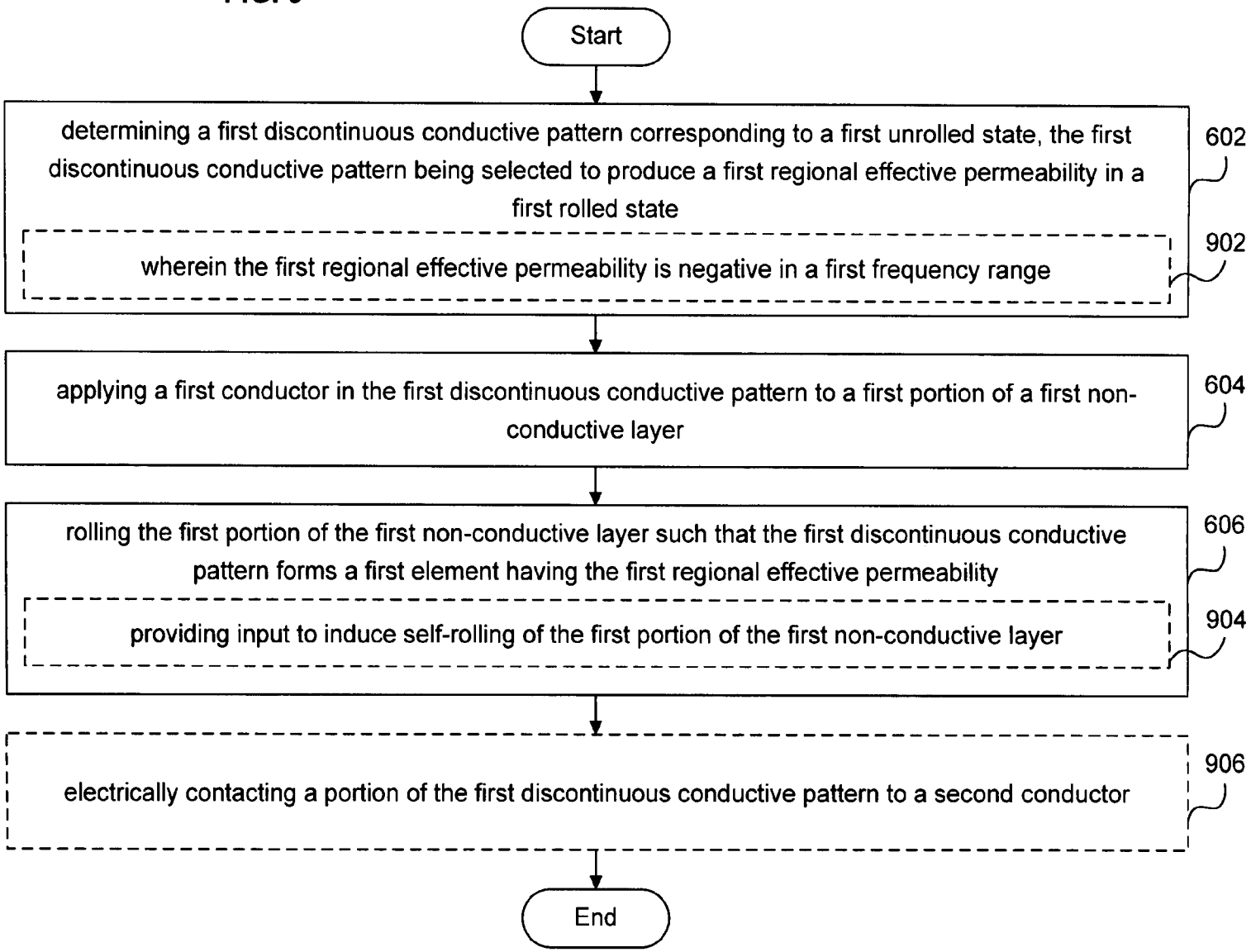

As shown in the flow chart of FIG. 9, (902) the first regional effective permeability may be negative in a first frequency range. In one embodiment, (606) rolling the first portion of the first non-conductive layer such that the first discontinuous conductive pattern forms a first element having the first regional effective permeability may include (904) providing input to induce self-rolling of the first portion of the first non-conductive layer. The method may further comprise (906) electrically contacting a portion of the first discontinuous conductive pattern to a second conductor.

Figure 10:
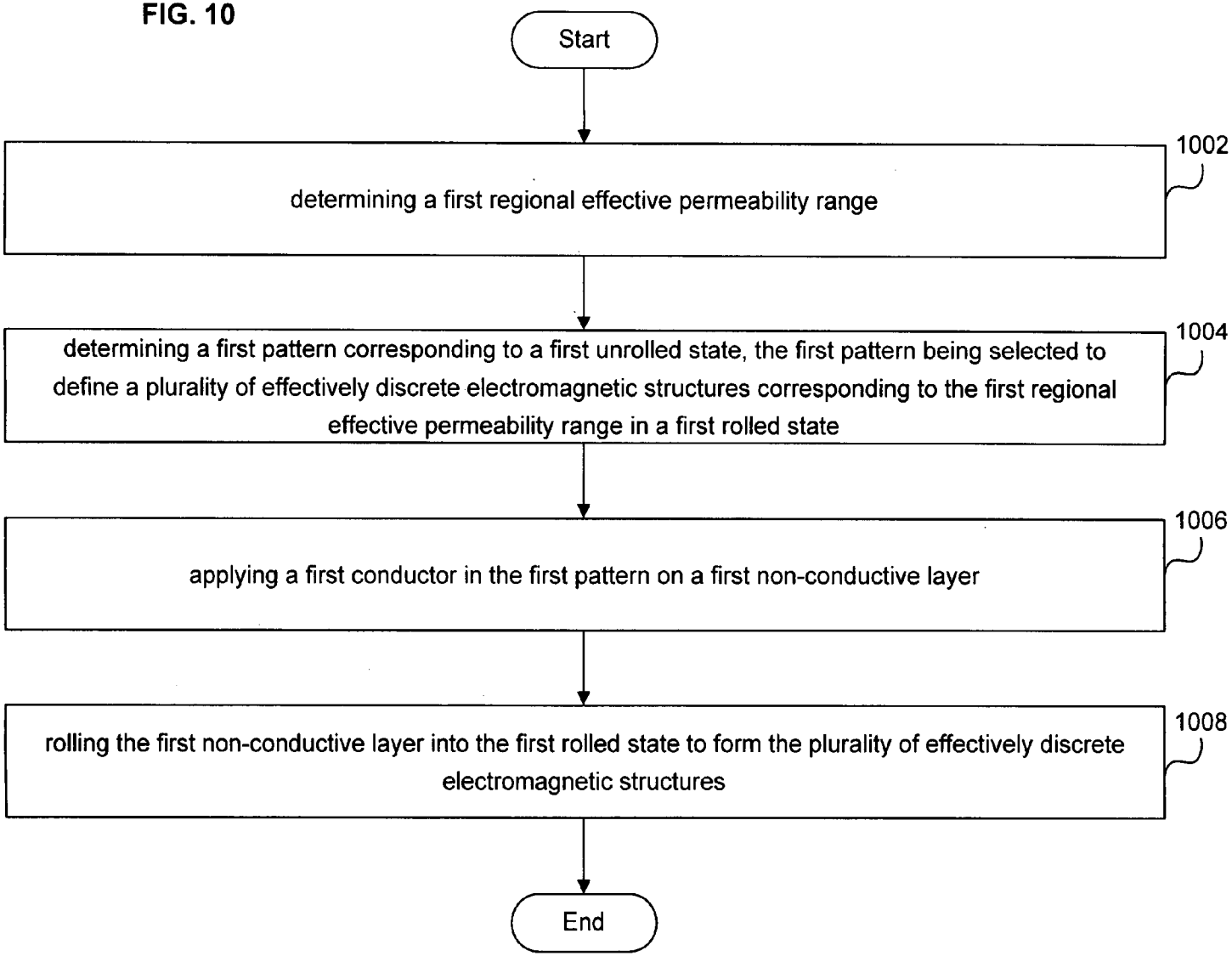
FIG. 10 is a flow chart depicting a method.

In one embodiment, a method, shown in the flow chart of FIG. 10, comprises (1002) determining a first regional effective permeability range, (1004) determining a first pattern corresponding to a first unrolled state, the first pattern being selected to define a plurality of effectively discrete electromagnetic structures corresponding to the first regional effective permeability range in a first rolled state, (1006) applying a first conductor in the first pattern on a first non-conductive layer, and (1008) rolling the first non-conductive layer into the first rolled state to form the plurality of effectively discrete electromagnetic structures.

Figure 11:
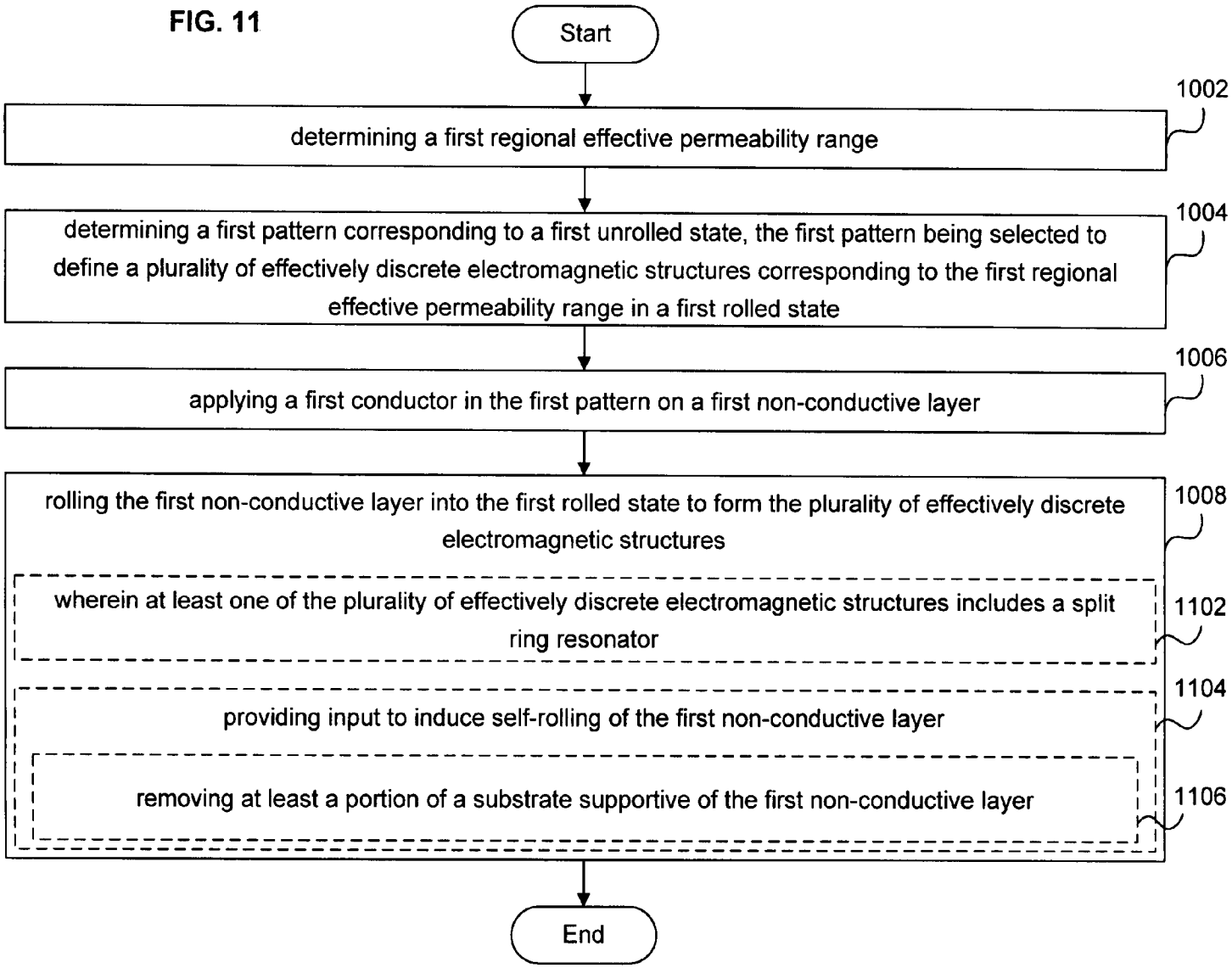
FIGS. 11-12 depict variants of the flow chart of FIG. 10.

In one embodiment, shown in the flow chart of FIG. 11, (1102) at least one of the plurality of effectively discrete electromagnetic structures may include a split ring resonator. In another embodiment, (1008) rolling the first non-conductive layer into the first rolled state to form the plurality of effectively discrete electromagnetic structures may include (1104) providing input to induce self-rolling of the first non-conductive layer, which may further include (1106) removing at least a portion of a substrate supportive of the first non-conductive layer.

Figure 12:
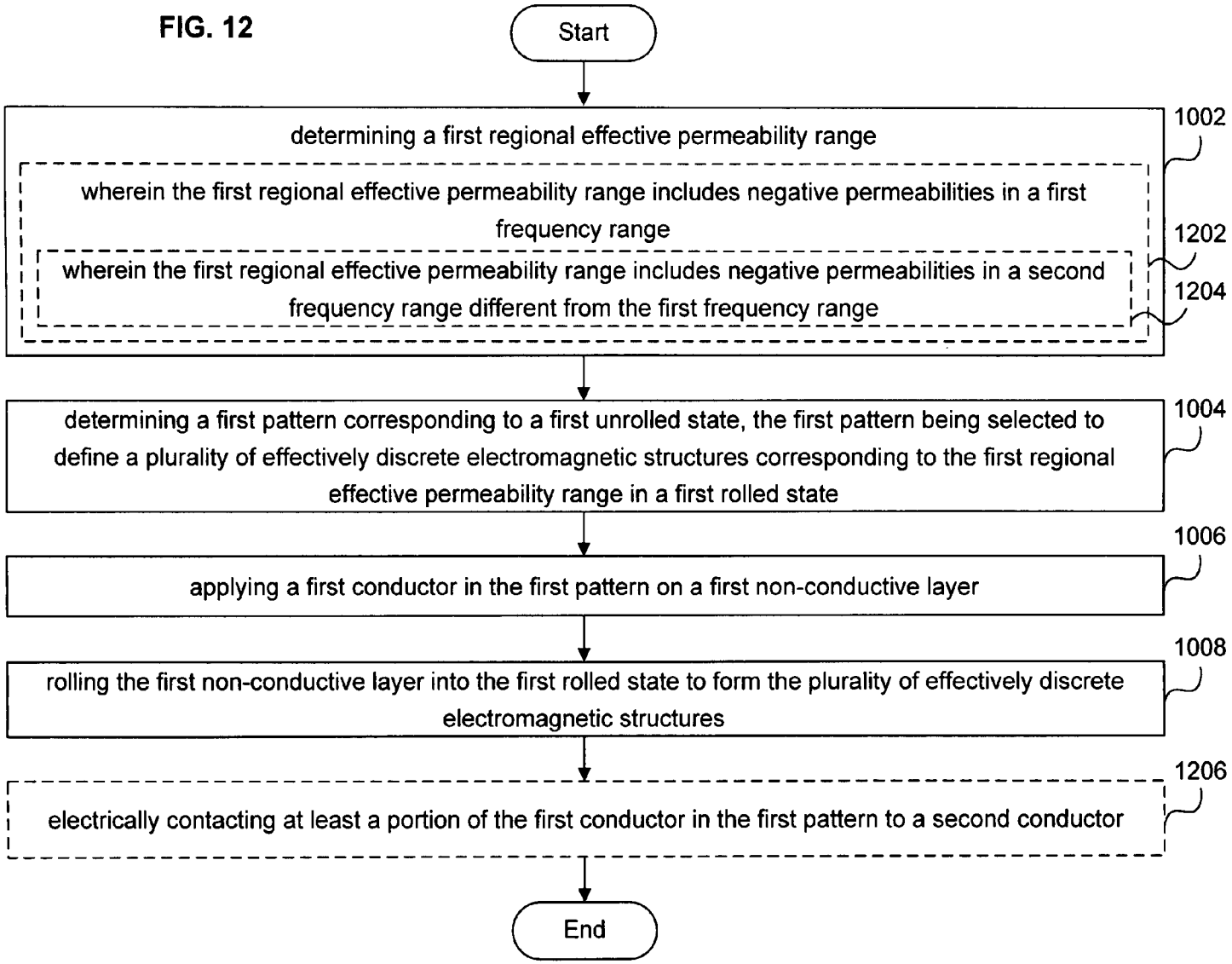

In one embodiment, shown in the flow chart of FIG. 12, (1202) the first regional effective permeability range may include negative permeabilities in a first frequency range, and (1204) the first regional effective permeability range may include negative permeabilities in a second frequency range different from the first frequency range. The method may further comprise (1206) electrically contacting at least a portion of the first conductor in the first pattern to a second conductor.

Figure 13:
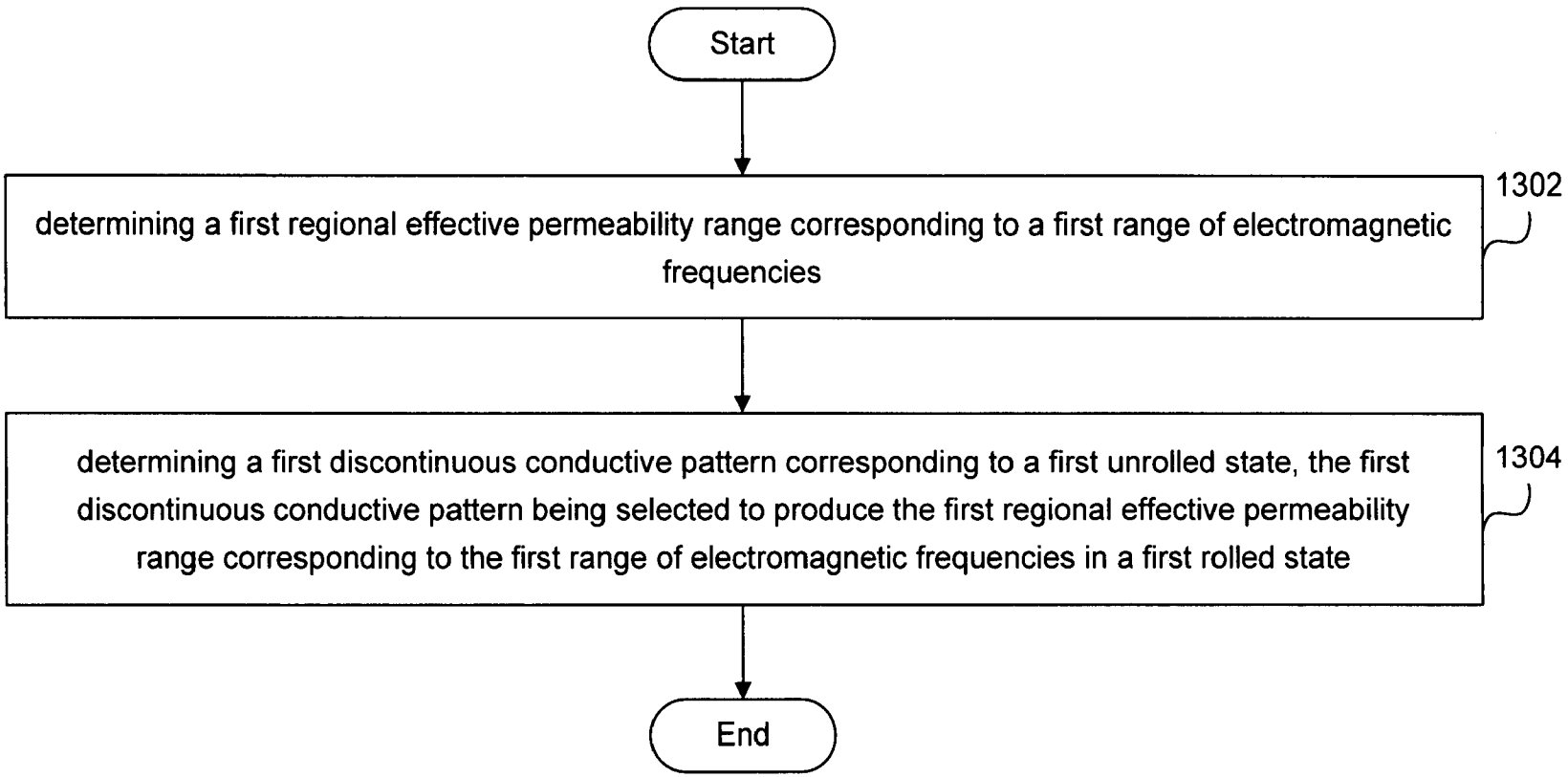
FIG. 13 is a flow chart depicting a method.

In one embodiment, a method, shown in the flow chart of FIG. 13, comprises (1302) determining a first regional effective permeability range corresponding to a first range of electromagnetic frequencies, and (1304) determining a first discontinuous conductive pattern corresponding to a first unrolled state, the first discontinuous conductive pattern being selected to produce the first regional effective permeability range corresponding to the first range of electromagnetic frequencies in a first rolled state.

Figure 14:
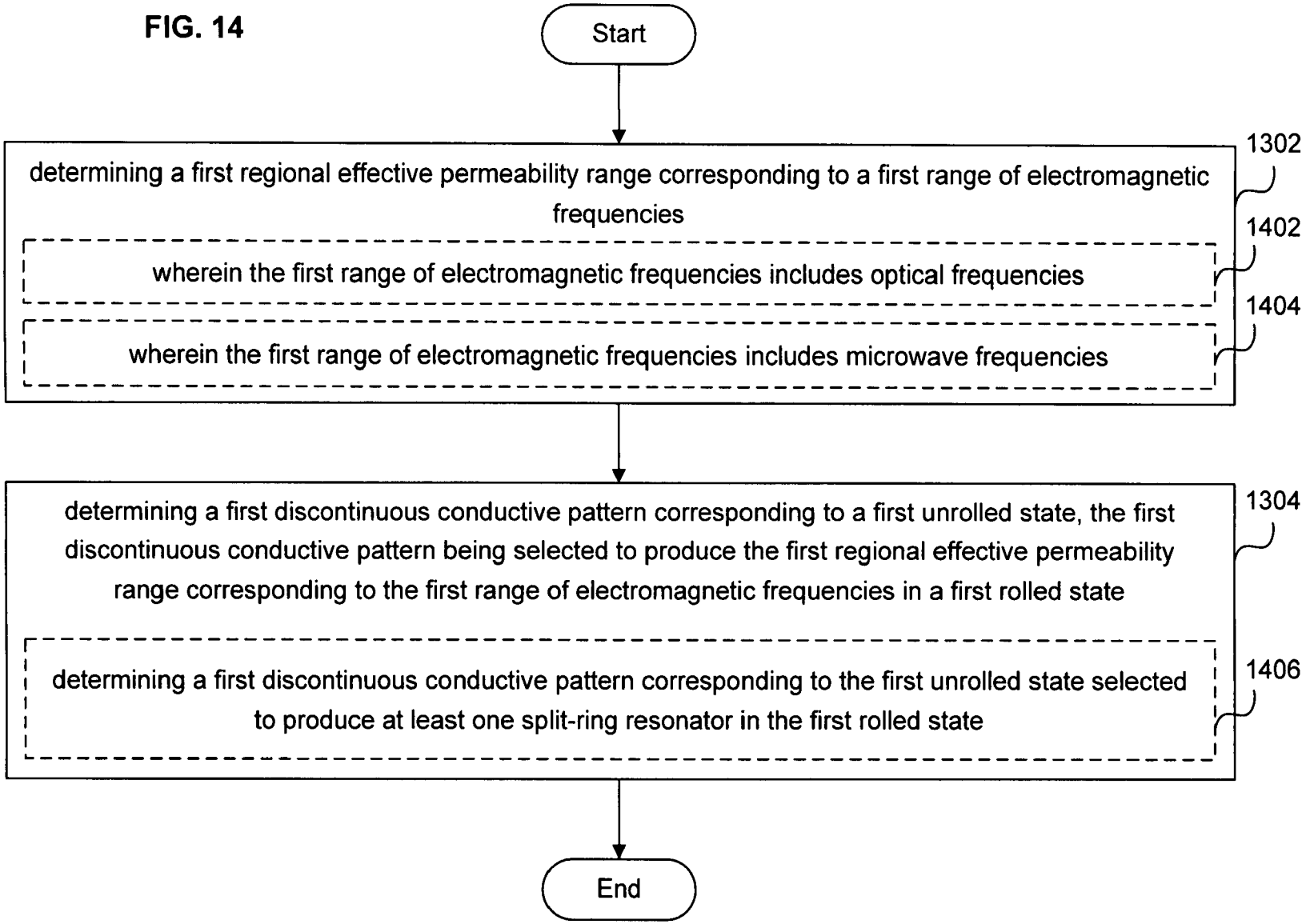
FIG. 14 depict variants of the flow chart of FIG. 13.

In one embodiment, shown in the flow chart of FIG. 14, (1402) the first range of electromagnetic frequencies may include optical frequencies, and/or (1404) the first range of electromagnetic frequencies may include microwave frequencies. In another embodiments, (1304) determining a first discontinuous conductive pattern corresponding to a first unrolled state, the first discontinuous conductive pattern being selected to produce the first regional effective permeability range corresponding to the first range of electromagnetic frequencies in a first rolled state may include (1406) determining a first discontinuous conductive pattern corresponding to the first unrolled state selected to produce at least one split-ring resonator in the first rolled state.

Figure 15:
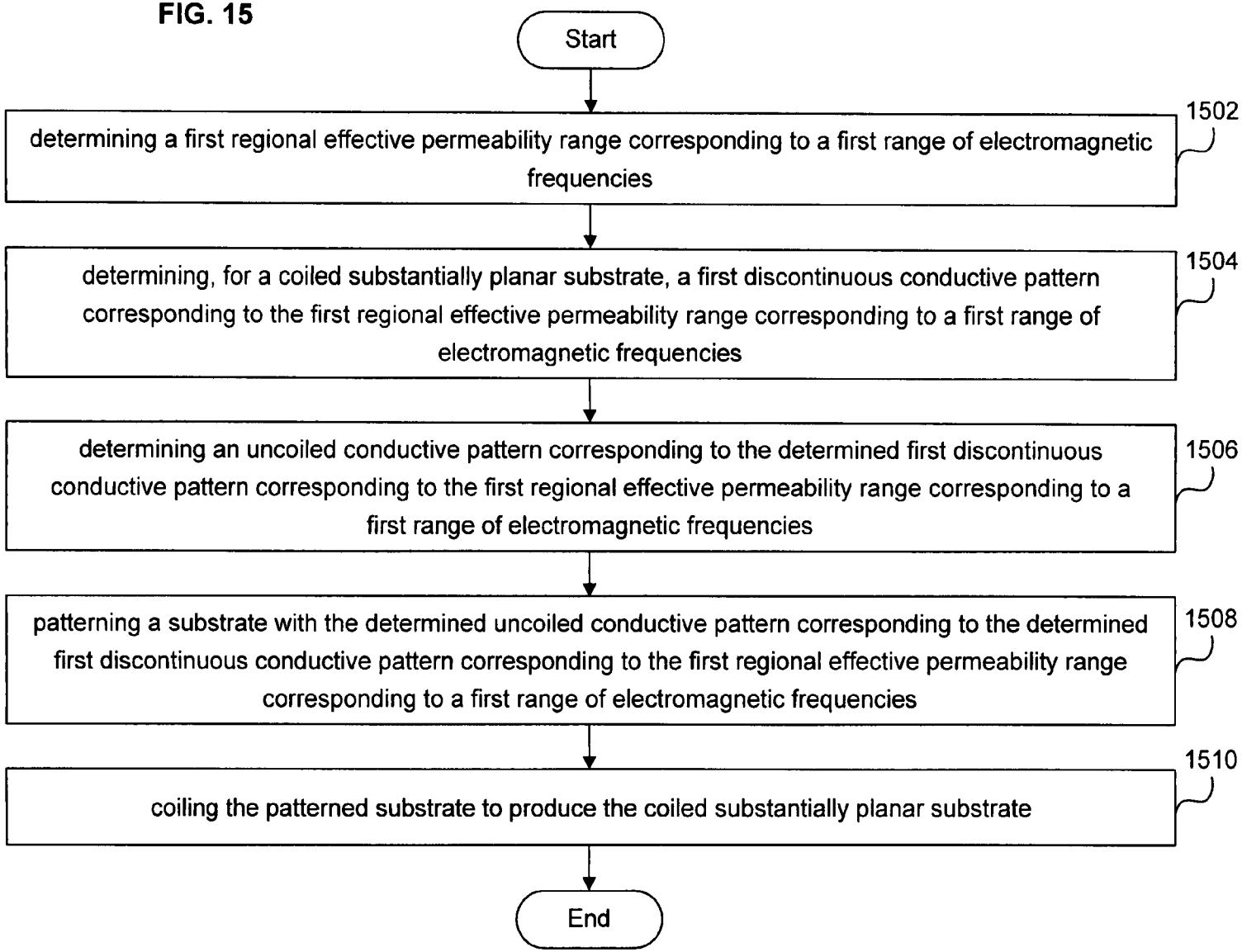
FIG. 15 is a flow chart depicting a method.

In one embodiment, a method, shown in the flow chart of FIG. 15 comprises (1502) determining a first regional effective permeability range corresponding to a first range of electromagnetic frequencies, (1504) determining, for a coiled substantially planar substrate, a first discontinuous conductive pattern corresponding to the first regional effective permeability range corresponding to a first range of electromagnetic frequencies, (1506) determining an uncoiled conductive pattern corresponding to the determined first discontinuous conductive pattern corresponding to the first regional effective permeability range corresponding to a first range of electromagnetic frequencies, (1508) patterning a substrate with the determined uncoiled conductive pattern corresponding to the determined first discontinuous conductive pattern corresponding to the first regional effective permeability range corresponding to a first range of electromagnetic frequencies, and (1510) coiling the patterned substrate to produce the coiled substantially planar substrate.

Figure 16:
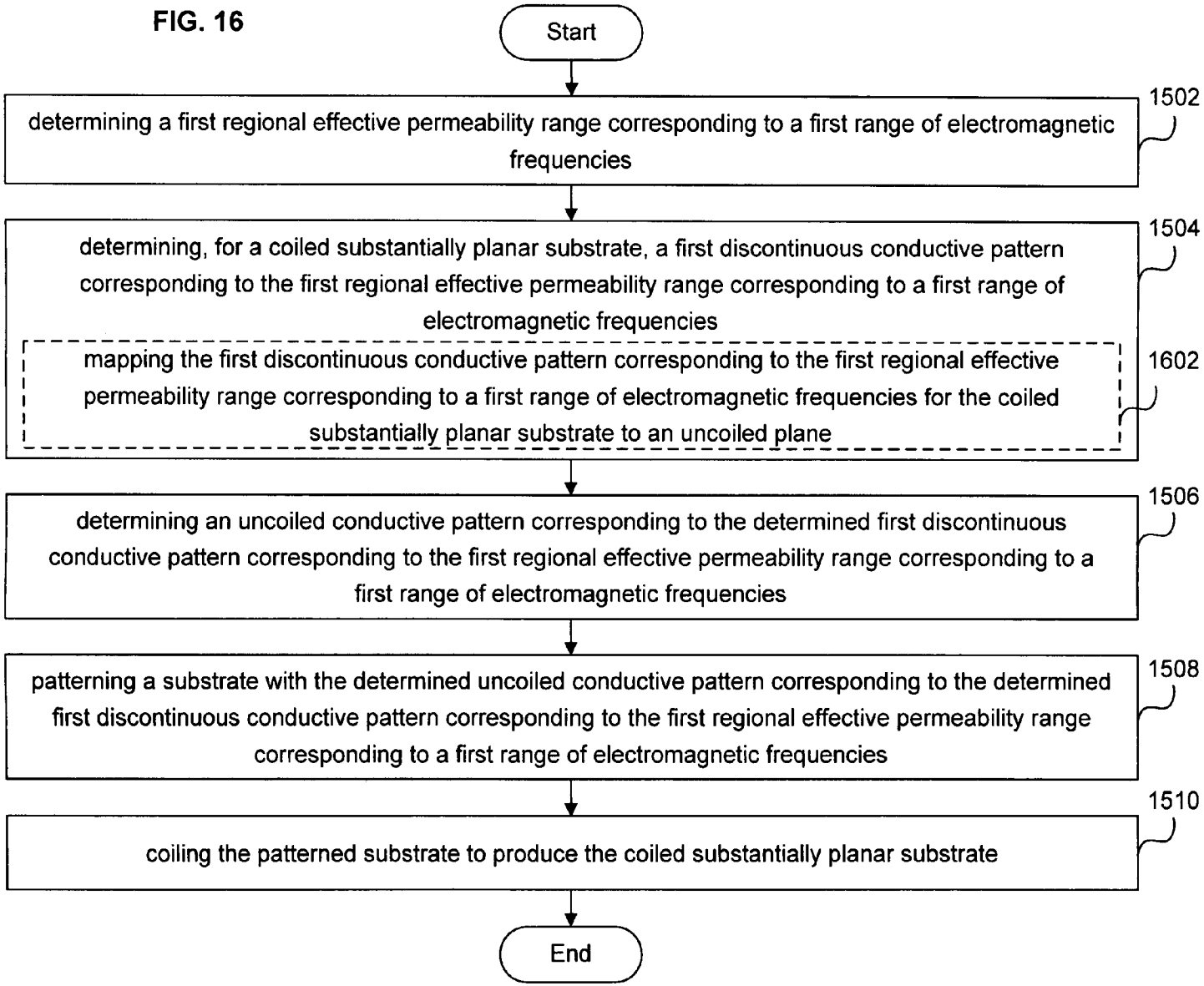
FIG. 16 depicts a variant of the flow chart of FIG. 15.

In one embodiment, shown in the flow chart of FIG. 16 (1504) determining, for a coiled substantially planar substrate, a first discontinuous conductive pattern corresponding to the first regional effective permeability range corresponding to a first range of electromagnetic frequencies may include (1602) mapping the first discontinuous conductive pattern corresponding to the first regional effective permeability range corresponding to a first range of electromagnetic frequencies for the coiled substantially planar substrate to an uncoiled plane.

Those having skill in the art will recognize that the state of the art has progressed to the point where there is little distinction left between hardware, software, and/or firmware implementations of aspects of systems; the use of hardware, software, and/or firmware is generally (but not always, in that in certain contexts the choice between hardware and software can become significant) a design choice representing cost vs. efficiency tradeoffs. Those having skill in the art will appreciate that there are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software implementation; or, yet again alternatively, the implementer may opt for some combination of hardware, software, and/or firmware. Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary. Those skilled in the art will recognize that optical aspects of implementations will typically employ optically-oriented hardware, software, and or firmware.

In some implementations described herein, logic and similar implementations may include software or other control structures suitable to operation. Electronic circuitry, for example, may manifest one or more paths of electrical current constructed and arranged to implement various logic functions as described herein. In some implementations, one or more media are configured to bear a device-detectable implementation if such media hold or transmit a special-purpose device instruction set operable to perform as described herein. In some variants, for example, this may manifest as an update or other modification of existing software or firmware, or of gate arrays or other programmable hardware, such as by performing a reception of or a transmission of one or more instructions in relation to one or more operations described herein. Alternatively or additionally, in some variants, an implementation may include special-purpose hardware, software, firmware components, and/or general-purpose components executing or otherwise invoking special-purpose components. Specifications or other implementations may be transmitted by one or more instances of tangible transmission media as described herein, optionally by packet transmission or otherwise by passing through distributed media at various times.

Alternatively or additionally, implementations may include executing a special-purpose instruction sequence or otherwise invoking circuitry for enabling, triggering, coordinating, requesting, or otherwise causing one or more occurrences of any functional operations described above. In some variants, operational or other logical descriptions herein may be expressed directly as source code and compiled or otherwise invoked as an executable instruction sequence. In some contexts, for example, C++ or other code sequences can be compiled directly or otherwise implemented in high-level descriptor languages (e.g., a logic-synthesizable language, a hardware description language, a hardware design simulation, and/or other such similar mode(s) of expression). Alternatively or additionally, some or all of the logical expression may be manifested as a Verilog-type hardware description or other circuitry model before physical implementation in hardware, especially for basic operations or timing-critical applications. Those skilled in the art will recognize how to obtain, configure, and optimize suitable transmission or computational elements, material supplies, actuators, or other common structures in light of these teachings.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link (e.g., transmitter, receiver, transmission logic, reception logic, etc.), etc.).

In a general sense, those skilled in the art will recognize that the various embodiments described herein can be implemented, individually and/or collectively, by various types of electromechanical systems having a wide range of electrical components such as hardware, software, firmware, and/or virtually any combination thereof; and a wide range of components that may impart mechanical force or motion such as rigid bodies, spring or torsional bodies, hydraulics, electromagnetically actuated devices, and/or virtually any combination thereof. Consequently, as used herein "electromechanical system" includes, but is not limited to, electrical circuitry operably coupled with a transducer (e.g., an actuator, a motor, a piezoelectric crystal, a Micro Electro Mechanical System (MEMS), etc.), electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), electrical circuitry forming a communications device (e.g., a modem, communications switch, optical-electrical equipment, etc.), and/or any non-electrical analog thereto, such as optical or other analogs. Those skilled in the art will also appreciate that examples of electro-mechanical systems include but are not limited to a variety of consumer electronics systems, medical devices, as well as other systems such as motorized transport systems, factory automation systems, security systems, and/or communication/computing systems. Those skilled in the art will recognize that electromechanical as used herein is not necessarily limited to a system that has both electrical and mechanical actuation except as context may dictate otherwise.

In a general sense, those skilled in the art will recognize that the various aspects described herein which can be implemented, individually and/or collectively, by a wide range of hardware, software, firmware, and/or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), and/or electrical circuitry forming a communications device (e.g., a modem, communications switch, optical-electrical equipment, etc.). Those having skill in the art will recognize that the subject matter described herein may be implemented in an analog or digital fashion or some combination thereof.

Those skilled in the art will recognize that at least a portion of the devices and/or processes described herein can be integrated into an image processing system. Those having skill in the art will recognize that a typical image processing system generally includes one or more of a system unit housing, a video display device, memory such as volatile or non-volatile memory, processors such as microprocessors or digital signal processors, computational entities such as operating systems, drivers, applications programs, one or more interaction devices (e.g., a touch pad, a touch screen, an antenna, etc.), control systems including feedback loops and control motors (e.g., feedback for sensing lens position and/or velocity; control motors for moving/distorting lenses to give desired focuses). An image processing system may be implemented utilizing suitable commercially available components, such as those typically found in digital still systems and/or digital motion systems.

Those skilled in the art will recognize that at least a portion of the devices and/or processes described herein can be integrated into a data processing system. Those having skill in the art will recognize that a data processing system generally includes one or more of a system unit housing, a video display device, memory such as volatile or non-volatile memory, processors such as microprocessors or digital signal processors, computational entities such as operating systems, drivers, graphical user interfaces, and applications programs, one or more interaction devices (e.g., a touch pad, a touch screen, an antenna, etc.), and/or control systems including feedback loops and control motors (e.g., feedback for sensing position and/or velocity; control motors for moving and/or adjusting components and/or quantities). A data processing system may be implemented utilizing suitable commercially available components, such as those typically found in data computing/communication and/or network computing/communication systems.

Those skilled in the art will recognize that it is common within the art to implement devices and/or processes and/or systems, and thereafter use engineering and/or other practices to integrate such implemented devices and/or processes and/or systems into more comprehensive devices and/or processes and/or systems. That is, at least a portion of the devices and/or processes and/or systems described herein can be integrated into other devices and/or processes and/or systems via a reasonable amount of experimentation. Those having skill in the art will recognize that examples of such other devices and/or processes and/or systems might include—as appropriate to context and application—all or part of devices and/or processes and/or systems of (a) an air conveyance (e.g., an airplane, rocket, helicopter, etc.), (b) a ground conveyance (e.g., a car, truck, locomotive, tank, armored personnel carrier, etc.), (c) a building (e.g., a home, warehouse, office, etc.), (d) an appliance (e.g., a refrigerator, a washing machine, a dryer, etc.), (e) a communications system (e.g., a networked system, a telephone system, a Voice over IP system, etc.), (f) a business entity (e.g., an Internet Service Provider (ISP) entity such as Comcast Cable, Qwest, Southwestern Bell, etc.), or (g) a wired/wireless services entity (e.g., Sprint, Cingular, Nextel, etc.), etc.

In certain cases, use of a system or method may occur in a territory even if components are located outside the territory. For example, in a distributed computing context, use of a distributed computing system may occur in a territory even though parts of the system may be located outside of the territory (e.g., relay, server, processor, signal-bearing medium, transmitting computer, receiving computer, etc. located outside the territory).

A sale of a system or method may likewise occur in a territory even if components of the system or method are located and/or used outside the territory.

Further, implementation of at least part of a system for performing a method in one territory does not preclude use of the system in another territory.

All of the above U.S. patents, U.S. patent application publications, U.S. patent applications, foreign patents, foreign patent applications and non-patent publications referred to in this specification and/or listed in any Application Data Sheet are incorporated herein by reference, to the extent not inconsistent herewith.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components may be referred to herein as "configured to," "configurable to," "operable/operative to," "adapted/adaptable," "able to," "conformable/conformed to," etc. Those skilled in the art will recognize that "configured to" can generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method of fabricating an array of elements, comprising:

determining a first discontinuous conductive pattern corresponding to a first unrolled state, the first discontinuous conductive pattern being selected to produce a first regional effective permeability in a first rolled state, the first rolled state having an axis defining an axial direction;

applying a first conductor to form the first discontinuous conductive pattern to a first portion of a first non-conductive layer; and rolling the first portion of the first non-conductive layer such that the first discontinuous conductive pattern forms the array of elements, wherein at least one element in the array of elements has the first regional effective permeability, and wherein the array of elements includes at least two elements that do not overlap along the axial direction.

2. The method of claim 1 wherein the at least one element having the first regional effective permeability includes a split-ring resonator.

3. The method of claim 1 wherein applying the first conductor to form the first discontinuous conductive pattern to the first portion of the first non-conductive layer includes:

etching a trench in the first portion of the first non-conductive layer; and applying the first conductor to the trench.

4. The method of claim 1 wherein rolling the first portion of the first non-conductive layer such that the first discontinuous conductive pattern forms the array of elements includes:

removing at least a portion of a substrate supportive of the first portion of the first non-conductive layer.

5. The method of claim 4 wherein removing at least the portion of the substrate supportive of the first portion of the first non-conductive layer further includes:

etching the substrate.

6. The method of claim 1 wherein the first discontinuous conductive pattern is further selected to produce a second regional effective permeability different from the first regional effective permeability, and wherein at least one element in the array of elements has the second regional effective permeability.

7. The method of claim 1 wherein rolling the first portion of the first non-conductive layer includes:

providing input to induce self-rolling of the first portion of the first non-conductive layer.

8. The method of claim 1 further comprising:

electrically contacting a portion of the first discontinuous conductive pattern to a second conductor.

9. The method of claim 1 wherein the first regional effective permeability is negative in a first frequency range.

10. A method of fabricating a metamaterial, comprising:

determining a first regional effective permeability range;

determining a first pattern corresponding to a first unrolled state, the unrolled state being characterized by a rolling direction and a second direction substantially orthogonal to the rolling direction, the first pattern being selected to define a plurality of effectively discrete electromagnetic structures corresponding to the first regional effective permeability range in a first rolled state, the first pattern being discontinuous along the second direction;

applying a first conductor to form the first pattern on a first non-conductive layer; and rolling the first non-conductive layer in the rolling direction into the first rolled state to form the plurality of effectively discrete electromagnetic structures.

11. The method of claim 10 wherein at least one of the plurality of effectively discrete electromagnetic structures includes a split ring resonator.

12. The method of claim 10 wherein rolling the first non-conductive layer into the first rolled state to form the plurality of effectively discrete electromagnetic structures includes:

providing input to induce self-rolling of the first non-conductive layer.

13. The method of claim 12 wherein providing the input to induce self-rolling of the first non-conductive layer includes:

removing at least a portion of a substrate supportive of the first non-conductive layer.

14. The method of claim 10, further comprising:

electrically contacting at least a portion of the first conductor in the first pattern to a second conductor.

15. The method of claim 10 wherein the first regional effective permeability range includes negative permeabilities in a first frequency range.

16. The method of claim 15 wherein the first regional effective permeability range includes negative permeabilities in a second frequency range different from the first frequency range.

17. An array of resonant elements achieved by the process of:

determining a first discontinuous conductive pattern corresponding to a first unrolled state, the first conductive pattern being selected to produce a first regional effective permeability in a first rolled state, the first rolled state having an axis defining an axial direction;

applying a first conductor to form the first conductive pattern to a first portion of a first non-conductive layer; and rolling the first portion of the first non-conductive layer such that the first conductive pattern forms an array of elements, wherein at least one element in the array of elements has the first regional effective permeability, and wherein the array of elements includes at least two elements that do not overlap along the axial direction.

18. The array of resonant elements of claim 17 wherein the first discontinuous conductive pattern corresponding to the first unrolled state is substantially planar.

19. The array of resonant elements of claim 17 wherein the first regional effective permeability is negative in a first frequency range.

20. The array of resonant elements of claim 17 further achieved by the process of:

forming the first portion of the first non-conductive layer on a second non-conductive layer, the first portion of the first non-conductive layer having a different atomic spacing than the second non-conductive layer.

21. The array of resonant elements of claim 17 wherein the process of rolling the first portion of the first non-conductive layer further includes:

removing the first non-conductive layer from a substrate.

22. An apparatus, comprising:

a first layer of a first material; and a substantially discontinuous patterned conductor on the first layer, wherein the first layer and the patterned conductor form a rolled structure, the rolled structure having an axis defining an axial direction, and wherein the rolled patterned conductor forms an array of resonant elements including at least two resonant elements that do not overlap in the axial direction, wherein a first resonant element in the array of resonant elements is responsive to electromagnetic energy to resonate at a first resonant frequency, the first resonant element having at least one anomalous electromagnetic property in a first frequency range proximate to the first resonant frequency.

23. The apparatus of claim 22 wherein the first resonant element includes a first split-ring resonator.

24. The apparatus of claim 23 wherein the first resonant element further includes a second split-ring resonator different from the first split ring resonator, wherein the second split-ring resonator is substantially concentric with the first split-ring resonator.

25. The apparatus of claim 22 wherein the at least one anomalous electromagnetic property includes a negative permeability.

26. The apparatus of claim 22 wherein the at least one anomalous electromagnetic property includes a negative permittivity.

27. The apparatus of claim 22 wherein the first resonant element is configured to couple to electromagnetic energy in a first frequency range.

28. The apparatus of claim 27 wherein the first frequency range includes optical frequencies.

29. The apparatus of claim 27 wherein the first frequency range includes microwave frequencies.

30. The apparatus of claim 22 wherein the first resonant element is configured to couple to electromagnetic energy having a first polarization.

31. The apparatus of claim 22 further comprising a second layer of a second material in direct contact with the first layer of the first material, the second layer of the second material having a different atomic spacing from the first layer of the first material.

32. The apparatus of claim 22 wherein the first resonant element is substantially two-dimensional.

33. The apparatus of claim 22 wherein the substantially discontinuous patterned conductor forms a second resonant element responsive to electromagnetic energy to resonate at a second resonant frequency.

34. The apparatus of claim 33 wherein the second resonant frequency is different from the first resonant frequency.

35. A metamaterial, comprising:

a first layer of a first material, the first layer being characterized by a rolling direction and a second direction substantially orthogonal to the rolling direction; and a discontinuous patterned conductor on the first layer, wherein the first layer and the patterned conductor form a first rolled structure, the first rolled structure forming at least three discrete electromagnetic elements that do not overlap along the second direction, and wherein the at least three discrete electromagnetic elements are characterized by a net effective permeability, the net effective permeability being negative in a first frequency range.

36. The metamaterial of claim 35 wherein a first element of said at least three discrete electromagnetic elements is further characterized by a first regional effective permeability and wherein a second element of said at least three discrete electromagnetic elements is characterized by a second regional effective permeability different from the first regional effective permeability.

37. The metamaterial of claim 35 wherein the first rolled structure has a negative net effective index of refraction in a first frequency range.

38. The metamaterial of claim 35 further comprising:

a patterned conductor on a second layer different from the first layer, wherein the second layer and the patterned conductor form a second rolled structure, the second rolled structure forming an array of discrete electromagnetic elements, and wherein the array of discrete electromagnetic elements is characterized by a second net effective permeability.

39. A method comprising:

determining a first regional effective permeability range corresponding to a first range of electromagnetic frequencies; and determining a first discontinuous conductive pattern corresponding to a first unrolled state, the first discontinuous conductive pattern being selected to produce at least two non-concentric resonant elements in a rolled state, the at least two resonant elements being characterized by the first regional effective permeability range corresponding to the first range of electromagnetic frequencies.

40. The method of claim 39 wherein at least one of the at least two resonant elements includes a split-ring resonator.

41. The method of claim 39 wherein the first range of electromagnetic frequencies includes optical frequencies.

42. The method of claim 39 wherein the first range of electromagnetic frequencies includes microwave frequencies.

43. A method comprising:

determining a first regional effective permeability range corresponding to a first range of electromagnetic frequencies;

determining, for a coiled substantially planar substrate, a first discontinuous conductive pattern selected to produce at least two non-concentric resonant elements corresponding to the first regional effective permeability range;

determining an uncoiled conductive pattern corresponding to the determined first discontinuous conductive pattern;

patterning a substrate with the determined uncoiled conductive pattern corresponding to the determined first discontinuous conductive pattern; and coiling the patterned substrate to produce the coiled substantially planar substrate.

44. The method of claim 43 wherein determining the uncoiled conductive pattern includes:

mapping the first discontinuous conductive pattern for the coiled substantially planar substrate to an uncoiled plane.

* * * * *